US012631332B2

(12) United States Patent
Bin Ziad et al.

(10) Patent No.: US 12,631,332 B2
(45) Date of Patent: May 19, 2026

(54) LASER IGNITION SYSTEMS AND RELATED METHODS IN OIL AND GAS APPLICATIONS

(71) Applicant: Saudi Arabian Oil Company, Dhahran (SA)

(72) Inventors: Abdullah M. Bin Ziad, Udhailiyah (SA); Fisal A. Bukhari, Udhailiyah (SA); Khaled M. Althubiti, Udhailiyah (SA); Fahad O. Alshammari, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 343 days.

(21) Appl. No.: 18/350,548

(22) Filed: Jul. 11, 2023

(65) Prior Publication Data

US 2025/0020322 A1 Jan. 16, 2025

(51) Int. Cl.
*F23Q 13/00* (2006.01)
*F23G 7/08* (2006.01)

(52) U.S. Cl.
CPC ..... *F23Q 13/005* (2013.01); *F23G 7/085* (2013.01)

(58) Field of Classification Search
CPC ..... F02P 13/04; F23G 7/085; F23Q 13/005
USPC ..... 126/143 B; 431/5
See application file for complete search history.

(56) References Cited

U.S. PATENT DOCUMENTS

| | | | | |
|---|---|---|---|---|
| 5,043,131 | A * | 8/1991 | Musinski | G21B 1/19 976/DIG. 3 |
| 6,938,246 | B2 | 8/2005 | Alford et al. | |
| 8,356,382 | B2 | 1/2013 | Zeitlin | |
| 9,384,945 | B2 | 7/2016 | Ashida | |
| 2013/0112164 | A1* | 5/2013 | Morishima | F02P 23/04 123/143 B |
| 2013/0213005 | A1* | 8/2013 | Fullerton | F23Q 3/008 431/157 |

* cited by examiner

*Primary Examiner* — Vivek K Shirsat
(74) *Attorney, Agent, or Firm* — Fish & Richardson P.C.

(57) ABSTRACT

A laser ignition system for igniting an ignition target includes a support structure, a laser assembly mounted to the support structure and configured to deliver a laser beam to the ignition target, and an inlet mounted to the support structure and configured to deliver a coolant to the laser ignition system.

16 Claims, 2 Drawing Sheets

LASER IGNITION SYSTEMS AND RELATED METHODS IN OIL AND GAS APPLICATIONS

TECHNICAL FIELD

This disclosure relates to laser ignitions systems and related methods for operating such systems to ignite a gas during a flaring process.

BACKGROUND

Safely managing the outflow of gases produced during well testing and cleanup operations is a challenging task faced in the oil and gas industry. In this regard, flaring systems are commonly used to burn off excess gases that cannot be processed or stored. The flaring process requires a reliable ignition source to ignite the gas being flared. Conventionally, a supply of air, propane, and diesel are provided along with an ignition source for igniting the gas. However, these approaches, utilizing pilot flames, spark igniters, and multiple refills, can pose safety risks and negatively impact the environment.

SUMMARY

This disclosure relates to laser ignition systems and related methods for operating such systems to ignite a gas during a flaring process.

In one aspect, a laser ignition system for igniting an ignition target includes a support structure, a laser assembly mounted to the support structure and configured to deliver a laser beam to the ignition target, and an inlet mounted to the support structure and configured to deliver a coolant to the laser ignition system.

Embodiments may provide one or more of the following features.

In some embodiments, the support structure has an annular shape.

In some embodiments, the laser ignition system further includes a pipe segment to which the support structure is mounted.

In some embodiments, the support structure, the laser assembly, and the inlet together form a first assembly, and the laser ignition system further includes a second assembly including a second support structure, a second laser assembly, and a second inlet.

In some embodiments, the first and second assemblies are axially spaced from each other along a length of the pipe segment.

In some embodiments, the laser ignition system further includes a cooling system that supplies the coolant.

In some embodiments, the laser ignition system further includes a power source that powers the laser assembly.

In some embodiments, the laser assembly includes a laser that generates the laser beam and one or more optical components that direct the laser beam onto the ignition target.

In some embodiments, the laser ignition system further includes a control system that controls operations of the laser assembly to direct the laser beam onto the ignition target.

In some embodiments, the laser assembly is configured to direct the laser beam to a center point defined by the support structure.

In some embodiments, the ignition target is a gas.

In another aspect, a method of operating a laser ignition system includes flowing a gas through a pipe segment of the laser ignition system, generating a laser beam at a laser assembly mounted to a support structure of the laser ignition system, directing the laser beam onto the gas, and igniting the gas with the laser beam to flare the gas within the pipe segment.

Embodiments may provide one or more of the following features.

In some embodiments, the laser assembly includes a laser that generates the laser beam and one or more optical components that direct the laser beam onto the gas.

In some embodiments, the method further includes directing the laser beam onto a center point defined by the support structure.

In some embodiments, the method further includes flowing a coolant through the laser ignition system.

The details of one or more embodiments are set forth in the accompanying drawings and description. Other features, aspects, and advantages of the embodiments will become apparent from the description, drawings, and claims.

DETAILED DESCRIPTION

Figure 1:
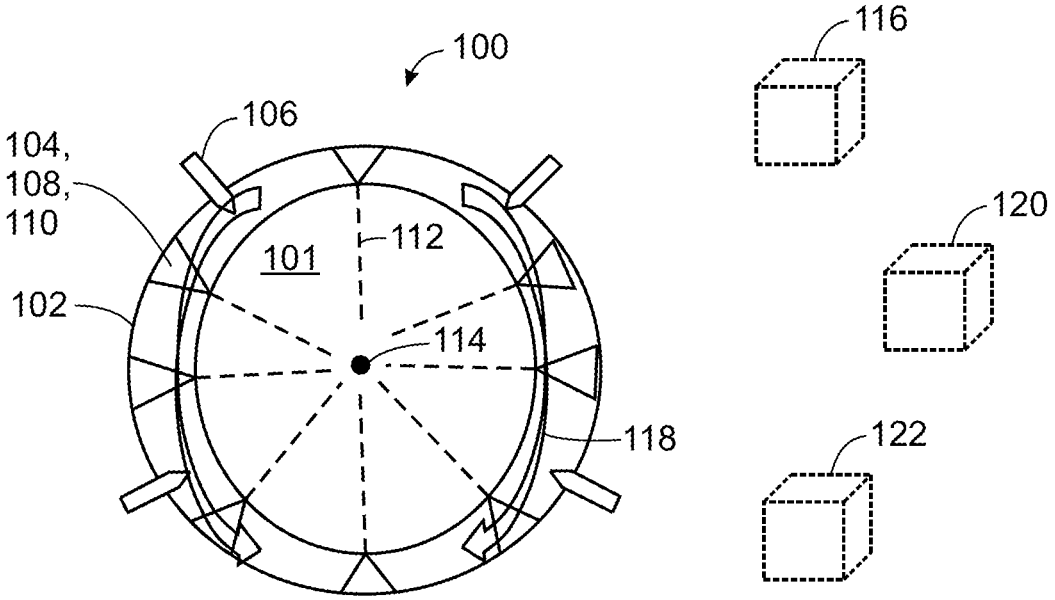
FIG. 1 is a cross-sectional view of an example laser ignition system.

FIG. 1 illustrates an example laser ignition system 100 for igniting an ignition target, such as a flammable gas 101 to be burned off during a flaring process. The laser ignition system 100 includes a support structure 102, multiple laser assemblies 104 that are mounted to the support structure 102, and multiple inlets 106 that are mounted to the support structure 102. In some embodiments, each inlet 106 includes a valve and a nozzle (e.g., a cooling nozzle or a low-volume spray nozzle) that operates with a pressurized fluid supply. The support structure 102 has a substantially annular cross-sectional shape, and the laser assemblies 104 and inlets 106 are spaced apart around a circumference of the support structure 102. In some embodiments, the support structure 102 has an outer diameter of about 16.8 centimeters (cm) to about 11.5 cm. In other embodiments, the outer diameter may have a different size, depending on an application of system 100.

Each laser assembly 104 includes a laser 108 and associated optics 110. The laser 108 emits a relatively high-energy beam 112 of light with a wavelength in a range of about 200 nanometers (nm) to about 550 nm, depending on the type of laser used and the composition of the hydrocarbon mixture of the gas 101. In some embodiments, the laser 108 may be a solid state laser or a fiber laser that produces relatively short, intense pulses of light, such as pulses with an energy of about 0.001 Joules (J) to about 1 J, depending on the application and specifications of the hydrocarbon mixture of the gas 101. Each set of optics 110 includes multiple components (e.g., mirrors, lenses, beam expanders, and other optical components) that direct and shape the beam 112 to focus the beam 112 with high precision onto the gas 101. For example, in some embodiments, the beams 112 are focused on a center point 114 of the support structure 102, where such center point 114 is surrounded by the gas 101.

The laser ignition system 100 also includes a cooling system 116 that provides a coolant 118 (indicated by the arrows 118) to be injected through the inlets 106 and into the support structure 102. The coolant may be a liquid (e.g., water, ethylene glycol, a propylene glycol mixture, or another liquid) or a gas (e.g., air or nitrogen) and prevents overheating of the support structure 102 that may otherwise occur due to heat generated by the lasers 108. In some embodiments, the choice of the coolant depends on factors such as the power, thermal requirements, operational environment, and specific cooling capabilities of the lasers 108. For example, for high-power lasers, more advanced cooling techniques (e.g., liquid coolants used with additional heat exchangers or refrigeration systems) may be employed to ensure effective cooling and temperature control.

In some embodiments, coolant injection parameters (e.g., flow rate, injection frequency, and duration) for the system 100 may vary depending on the system design, power level, cooling requirements, and thermal management strategy. In this manner, the cooling system 116 may prolong a life of the system 100, which, according to the embodiments described herein, may remain operational for up to several months to several years, depending on the system design, maintenance, operating conditions, and other factors.

The coolant flow rate (e.g., typically specified in fluid volume per unit time) determines the amount of coolant 118 circulated through the support structure 102 and is selected to effectively carry away heat generated by the lasers 108. The flow rate may depend on factors such as the power of the lasers 108, cooling requirements, and thermal conductivity of the coolant. In some embodiments, relatively high-power lasers require higher flow rates to maintain optimal cooling. In some embodiments, flow rates for the system 100 may range from about 2 liters per minute (L/min) to about 8 L/min. In some embodiments, such as for gas cooling systems, airflow coolant rates may range from about 5 meters cubed per hour ($m^3$/h) to about 20 ($m^3$/h).

The injection frequency refers to how often the coolant 118 is introduced into the system 100 and is typically based on the cooling needs and the thermal characteristics of the lasers 108. The frequency can vary from continuous injection (e.g., a constant flow) to intermittent injection based on thermal load fluctuations or certain operational requirements. Typically, the injection frequency is selected so as to maintain a stable operating temperature within the system 100. In some embodiments, the injection frequency may be about 5 times per second to manage varying thermal loads or certain operational requirements.

The injection duration represents the length of time during which the coolant 118 is actively introduced into the support structure 102. In some embodiments, the injection duration may be continuous if the system 100 has a constant cooling demand or intermittent if the system 100 needs cooling only during specific periods or in association with certain events. The duration is selected so as to adequately cool the system components and dissipate the generated heat, ensuring that the temperature remains within the desired operating range. In some embodiments, example injection durations may range from about 100 milliseconds (ms) to about 1 min, depending on the cooling needs of the system 100 and the time required to adequately dissipate heat.

The laser ignition system 100 further includes a computerized control system 120 that controls operation of various components of the laser ignition system 100, including operation of the laser assembly 104 to ensure precise timing and delivery of the beams 112 to the gas 101. The control system 120 may include one or more safety features that prevent accidental firing of the lasers 108. Example safety features include interlocks, emergency stops, safety interlocks for enclosures, laser power monitoring, temperature and cooling monitoring, and fault detection and diagnostic systems. The selection of safety features of the control system 120 or the system 100 more broadly may vary depending on the system design and regulatory requirements.

Interlocks prevent the laser ignition system 100 from operating under unsafe conditions and may include one or more of physical switches, sensors, and software-based checks that ensure certain criteria are met before the system 100 can be activated. An emergency stop (E-stop) button is a prominent, easily accessible control that immediately halts all system operations in the case of an emergency or hazardous situation. Additionally, the system 100 may be enclosed to prevent accidental exposure to laser radiation. Safety interlocks ensure that the enclosure is properly closed and that laser emission is inhibited when the enclosure is opened. Laser power monitoring systems can continuously monitor the output power of the laser source to ensure that the source remains within safe operating limits. If the power exceeds predetermined thresholds, appropriate actions can be taken to prevent hazards. Furthermore, monitoring the temperature of critical components and the cooling system 116 is important for preventing overheating and ensuring safe operation of the system 100. In some embodiments, alarms or automatic shutdowns may be triggered if temperatures exceed safe limits. In some embodiments, the control system 120 may incorporate fault detection and diagnostic capabilities to identify and notify operators of any malfunctions, abnormalities, or errors in the system 100. These capabilities help ensure prompt troubleshooting and corrective actions.

Additionally, the laser ignition system 100 includes a power source 122 that powers the various components of the laser ignition system 100. In some embodiments, the power source 122 may be provided as a power supply or a battery pack, depending on a configuration of the laser ignition system 100 and its size requirements.

Figure 2:
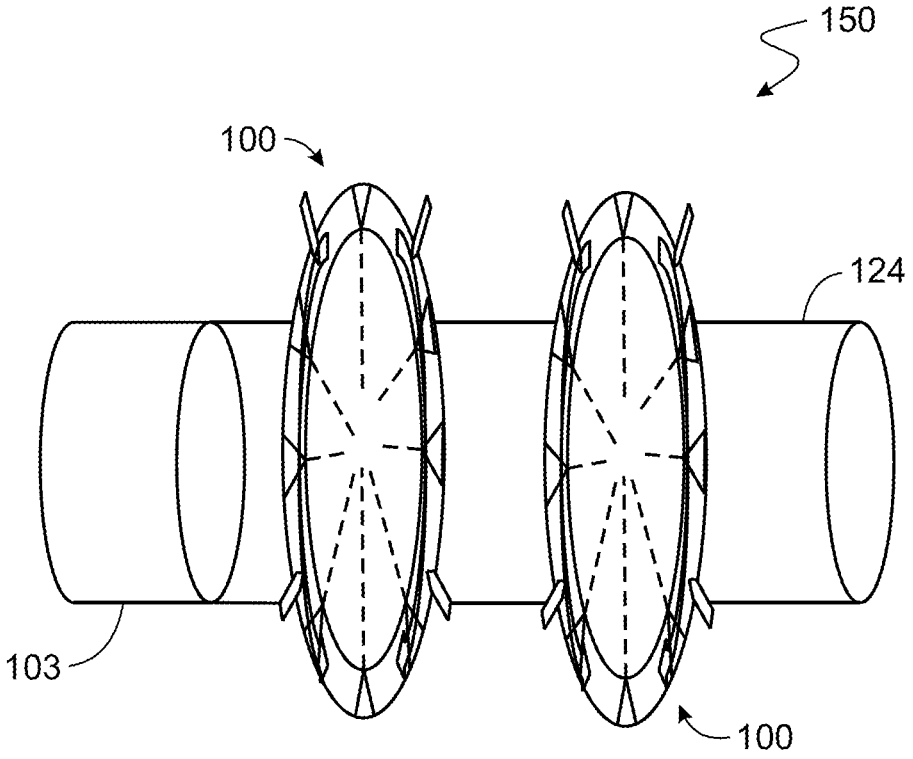
FIG. 2 is a perspective view of an example laser ignition system including two laser ignition systems of FIG. 1.

FIG. 2 illustrates an example laser system 150 (e.g., a flaring system). The laser ignition system 150 includes a pipe segment 124 (e.g., a connection sub) and two laser ignition systems 100. The pipe segment 124 is designed to be connected to the end of a flare line 103 and houses a flow of the gas 101. Portions of the laser ignition systems 100 are mounted to the pipe segment 124 at their respective support structures 102. In some embodiments, the support structures 102 are axially spaced from each other by a distance of about 0.5 m to about 1 m. In some embodiments, the pipe segment 124 has a length of about 1 m to about 1.5 m. The two laser ignition systems 100 (e.g., powered by separate, respective power sources 122) provide system redundancy to ensure continued ignition in case one of the laser ignition systems 100 malfunctions. In some embodiments, the laser ignition system 150 includes three or more laser ignition systems 100.

Figure 3:
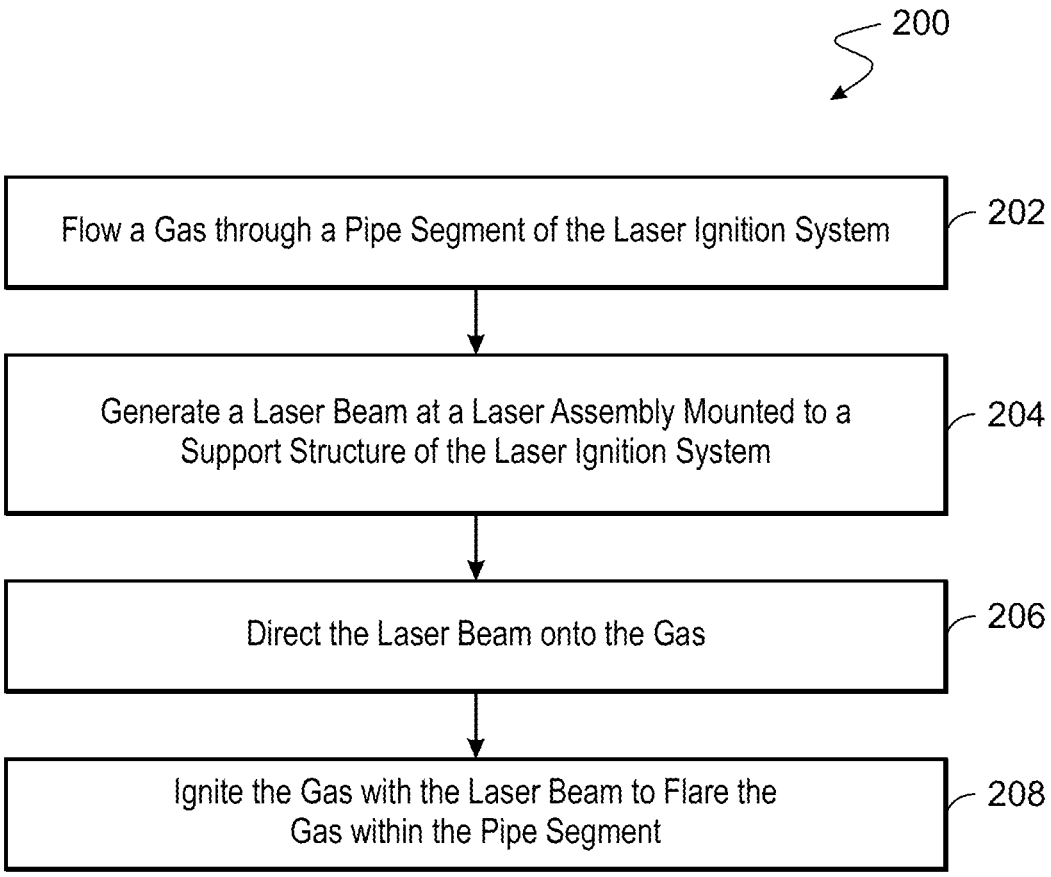
FIG. 3 is a flow chart illustrating an example method of operating the laser ignition system of FIG. 1 to ignite a gas during a flaring process.

FIG. 3 is a flow chart illustrating an example method 200 of operating a laser ignition system (e.g., the laser ignition system 100, 150). In some embodiments, the method 200 includes a step 202 for flowing a gas (e.g., the gas 101) through a pipe segment (e.g., the pipe segment 124) of the laser ignition system. In some embodiments, the method 200 includes a step 204 for generating a laser beam (e.g., the beam 112) at a laser assembly (e.g., the laser assembly 104) mounted to a support structure (e.g., the support structure 102) of the laser ignition system. In some embodiments, the method 200 includes a step 206 for directing the laser beam onto the gas. In some embodiments, the method 200 includes a step 208 for igniting the gas with the laser beam to flare the gas within the pipe segment.

The laser ignition systems 100, 150 offer several advantages compared to traditional ignition sources and systems. Such advantages include improved safety, increased efficiency, and reduced environmental impact. For example, by using the lasers 108 to ignite the gas 101 being flared, the risk of uncontrolled releases of gas and the associated safety hazards are significantly reduced. Furthermore, the systems 100, 150 are more precise and reliable than traditional systems, resulting in more efficient combustion and reduced emissions.

While the systems 100, 150 have been described and illustrated with respect to certain dimensions, sizes, shapes, arrangements, materials, and methods, in some embodiments, a system that is otherwise substantially similar in construction and function to either of the systems 100, 150 may include one or more different dimensions, sizes, shapes, arrangements, configurations, and materials or may be utilized according to different methods. For example, although the example laser ignition system 100 has been illustrated as including eight laser assemblies 104 and four inlets 106, in other embodiments, a laser ignition system that is otherwise substantially similar in construction and function to the laser ignition system 100 may include a different number of either or both of the laser assemblies 104 and the outlets 106.

Other embodiments are also within the scope of the following claims.

What is claimed is:

1. A laser ignition system for igniting an ignition target, the laser ignition system comprising:

a support structure comprising an annular internal space;

a plurality of laser assemblies mounted to the support structure and spaced apart from each other around a circumference of the support structure, wherein the plurality of laser assemblies are oriented to direct a plurality of respective laser beams in first respective radial directions to the ignition target, wherein the ignition target comprises a fluid that flows through the support structure in an axial direction that is perpendicular to the first respective radial directions; and a plurality of inlets mounted at an exterior circumferential wall of the support structure and spaced apart from each other around the circumference of the support structure, wherein the plurality of inlets are configured to deliver a coolant to the laser ignition system, and wherein the plurality of inlets are oriented in second respective radial directions to direct the coolant into the annular internal space of the support structure.

2. The laser ignition system of claim 1, wherein the support structure has an annular shape.

3. The laser ignition system of claim 1, further comprising a pipe segment to which the support structure is mounted.

4. The laser ignition system of claim 3, wherein the support structure, the laser assembly, and the plurality of inlets together comprise as a first assembly, and wherein the laser ignition system further comprises a second assembly comprising a second support structure, a second laser assembly, and a plurality of second inlets.

5. The laser ignition system of claim 4, wherein the first and second assemblies are axially spaced from each other along a length of the pipe segment.

6. The laser ignition system of claim 1, further comprising a cooling system that supplies the coolant.

7. The laser ignition system of claim 1, further comprising a power source that powers the laser assembly.

8. The laser ignition system of claim 1, wherein each laser assembly of the plurality of laser assemblies comprises a laser that generates the laser beam and one or more optical components that direct the laser beam onto the ignition target.

9. The laser ignition system of claim 1, further comprising a control system that controls operations of the laser assembly to direct the laser beam onto the ignition target.

10. The laser ignition system of claim 9, wherein the laser assembly is configured to direct the laser beam to a center point defined by the support structure.

11. The laser ignition system of claim 1, wherein the ignition target comprises a gas.

12. A method of operating a laser ignition system, the method comprising:

flowing a gas along an axial direction through a pipe segment of the laser ignition system;

generating a plurality of laser beams, respectively, at a plurality of laser assemblies mounted to a support structure of the laser ignition system, wherein the support structure comprises an annular internal space, wherein the plurality of laser assemblies are spaced apart from each other around a circumference of the support structure, wherein the plurality of laser assemblies are oriented to direct the plurality of laser beams in first respective radial directions toward the gas, and wherein the first respective radial directions are perpendicular to the axial direction;

directing the plurality of laser beams in the first respective radial directions onto the gas;

flowing a coolant into the laser ignition system through a plurality of inlets mounted at an exterior circumferential wall of the support structure, wherein the plurality of inlets are spaced apart from each other around the circumference of the support structure, and wherein the plurality of inlets are oriented in second respective radial directions to direct the coolant into the annular internal space of the support structure; and igniting the gas with the plurality of laser beams to flare the gas within the pipe segment.

13. The method of claim 12, wherein each laser assembly of the plurality of laser assemblies comprises a laser that generates a laser beam of the plurality of laser beams and one or more optical components that direct the laser beam onto the gas.

14. The method of claim 12, further comprising directing the laser beam onto a center point defined by the support structure.

15. The laser ignition system of claim 5, wherein each of the first and second assemblies defines a center point that is positioned along a central axis of the pipe segment.

16. The laser ignition system of claim 1, wherein laser ignition system is a flaring system that is configured to ignite the ignition target.

* * * * *